US007379866B2

(12) United States Patent
Gao

(10) Patent No.: US 7,379,866 B2
(45) Date of Patent: May 27, 2008

(54) SIMPLE NOISE SUPPRESSION MODEL

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 855 days.

(21) Appl. No.: 10/799,505

(22) Filed: Mar. 11, 2004

(65) Prior Publication Data

US 2005/0065792 A1 Mar. 24, 2005

Related U.S. Application Data

(60) Provisional application No. 60/455,435, filed on Mar. 15, 2003.

(51) Int. Cl.
*G10L 19/14* (2006.01)

(52) U.S. Cl. ..... 704/220; 704/225; 704/228; 704/233; 704/243

(58) Field of Classification Search ..... 704/226–228, 704/233, 220, 240, 243, 224, 225
See application file for complete search history.

(56) References Cited

U.S. PATENT DOCUMENTS 5,749,065 A * 5/1998 Nishiguchi et al. ..... 704/200.1
5,765,127 A * 6/1998 Nishiguchi et al. ..... 704/208
5,809,455 A * 9/1998 Nishiguchi et al. ..... 704/214
5,878,388 A * 3/1999 Nishiguchi et al. ..... 704/214
5,909,663 A * 6/1999 Iijima et al. ..... 704/226
5,960,388 A * 9/1999 Nishiguchi et al. ..... 704/208
6,263,312 B1 * 7/2001 Kolesnik et al. ..... 704/500
6,574,593 B1 6/2003 Gao et al.
6,611,800 B1 * 8/2003 Nishiguchi et al. ..... 704/221
6,766,292 B1 * 7/2004 Chandran et al. ..... 704/224
6,898,566 B1 * 5/2005 Benyassine et al. ..... 704/226
6,959,274 B1 * 10/2005 Gao et al. ..... 704/219
6,961,698 B1 * 11/2005 Gao et al. ..... 704/229
7,191,122 B1 * 3/2007 Gao et al. ..... 704/223

OTHER PUBLICATIONS

Massaloux, D., et al., *Spectral Shaping in the Proposed ITU-T 8kb/s Speech*, Proc. IEEE Workshop on Speech Coding, pp. 9-10, XP010269451 (Sep. 1995).

Wolfe, P.J., et al., *Towards a Perceptually Optimal Spectral Amplitude Estimator for Audio Signal Enhancement*, Accoustics, Speech, and Signal Processing, 2000, ICASSP '00, Proceedings, 2000 IEEE International Conference on Jun. 5-9, 2000, Piscataway, NJ, USA, IEEE, vol. 2, pp. 821-824, XP010504849 (Jun. 2000).

* cited by examiner

*Primary Examiner*—Vijay Chawan
(74) *Attorney, Agent, or Firm*—Farjami & Farjami LLP

(57) ABSTRACT

An approach for efficiently reducing background noise from speech signal in real-time applications is presented. A noisy input speech signal is processed through an inverse filter when the spectrum tilt of the input signal is not that of a pure background noise model the noisy input signal is also filtered in order to reduce the spectrum valley areas of the noisy input signal when the background noise is present.

18 Claims, 5 Drawing Sheets

SIMPLE NOISE SUPPRESSION MODEL

RELATED APPLICATIONS

The present application claims the benefit of U.S. provisional application Ser. No. 60/455,435, filed Mar. 15, 2003, which is hereby fully incorporated by reference in the present application.

U.S. patent application Ser. No. 10/799,533, "SIGNAL DECOMPOSITION OF VOICED SPEECH FOR CELP SPEECH CODING."

U.S. patent application Ser. No. 10/799,503, "VOICING INDEX CONTROLS FOR CELP SPEECH CODING."

U.S. patent application Ser. No. 10/799,460, "ADAPTIVE CORRELATION WINDOW FOR OPEN-LOOP PITCH."

U.S. patent application Ser. No. 10/799,504, "RECOVERING AN ERASED VOICE FRAME WITH TIME WARPING."

BACKGROUND OF THE INVENTION

1. Field of the Invention

The present invention relates generally to speech coding and, more particularly, to noise suppression 2. Related Art Generally, a speech signal can be band-limited to about 10 kHz without affecting its perception. However, in telecommunications, the speech signal bandwidth is usually limited much more severely. For instance, the telephone network limits the bandwidth of the speech signal to a band of between 300 Hz to 3400 Hz, which is known in the art as the "narrowband". Such band-limitation results in the characteristic sound of telephone speech. Both the lower limit of 300 Hz and the upper limit of 3400 Hz affect the speech quality.

In most digital speech coders, the speech signal is sampled at 8 kHz, resulting in a maximum signal bandwidth of 4 kHz. In practice, however, the signal is usually band-limited to about 3600 Hz at the high-end. At the low-end, the cut-off frequency is usually between 50 Hz and 200 Hz. The narrowband speech signal, which requires a sampling frequency of 8 kb/s, provides a speech quality referred to as toll quality. Although this toll quality is sufficient for telephone communications, for emerging applications such as teleconferencing, multimedia services and high-definition television, an improved quality is necessary.

The communications quality can be improved for such applications by increasing the bandwidth. For example, by increasing the sampling frequency to 16 kHz, a wider bandwidth, ranging from 50 Hz to about 7000 Hz can be accommodated. This wider bandwidth is referred to in the art as the "wideband". Extending the lower frequency range to 50 Hz increases naturalness, presence and comfort. At the other end of the spectrum, extending the higher frequency range to 7000 Hz increases intelligibility and makes it easier to differentiate between fricative sounds.

Background noise is usually a quasi-steady signal superimposed upon the voiced speech. For instance, assuming FIG. 1 represents the spectrum of an input speech signal and FIG. 2 represents a typical background noise spectrum. The goal of noise suppression systems is to reduce or suppress the background noise energy from the input speech.

To suppress the background noise, prior art systems divide the input speech spectrum into several segments (or channels). Each channel is then processed separately by estimating the signal-to-noise ratio (SNR) for that channel and applying appropriate gains to reduce the noise. For instance, if SNR is low, then the noise component in the segment is high and a gain much less than one is applied to reduce the magnitude of the noise. On the other hand, when SNR is high, then the noise component is insignificant and a gain closer to one is applied.

The problem with prior art noise suppression systems is that they are computationally cumbersome because they require complex fast Fourier transforms (FFT) and inverse FFT (IFFT). These FFT transformations are needed so that the signal can be manipulated in the frequency domain. In addition, some form of smoothing is required between frames to prevent discontinuities. Thus prior art approaches involve algorithms that is sometimes too complex for real-time applications.

The present invention provides a computationally simple noise suppression system applicable to real-time/real life applications.

SUMMARY OF THE INVENTION

In accordance with the purpose of the present invention as described herein, there is provided systems and methods for suppression of noise from an input speech signal. The noise, in the form of background noise, is suppressed by reducing the energy of the relatively noisy frequency components of the input signal. To accomplish this, one embodiment of the invention employs a special digital filtering model to reduce the background noise by simply filtering the noisy input signal. With this model, both the spectrum of the noisy input signal and the one of the pure background noise are represented by LPC (Linear Predictive Coding) filters in the z-domain, which can be obtained by simply performing LPC analysis.

In one or more embodiments, the shape of the noise spectrum is adequately represented with a simple first order LPC filter. Noise suppression occurs by applying a process that determines when the spectrum tilt of the noisy speech is close to the spectrum tilt of the background noise model so that only the spectrum valley areas of the noisy speech signal is reduced. And when the spectrum tilt of the noisy speech signal is not close to (e.g. less than) the spectrum tilt of the background noise model, an inverse filter of the noise model is used to decrease the energy of the noise component.

These and other aspects of the present invention will become apparent with further reference to the drawings and specification, which follow. It is intended that all such additional systems, methods, features and advantages be included within this description, be within the scope of the present invention, and be protected by the accompanying claims.

DETAILED DESCRIPTION

The present application may be described herein in terms of functional block components and various processing steps. It should be appreciated that such functional blocks may be realized by any number of hardware components and/or software components configured to perform the specified functions. For example, the present application may employ various integrated circuit components, e.g., memory elements, digital signal processing elements, transmitters, receivers, tone detectors, tone generators, logic elements, and the like, which may carry out a variety of functions under the control of one or more microprocessors or other control devices. Further, it should be noted that the present application may employ any number of conventional techniques for data transmission, signaling, signal processing and conditioning, tone generation and detection and the like. Such general techniques that may be known to those skilled in the art are not described in detail herein.

Figure 1:
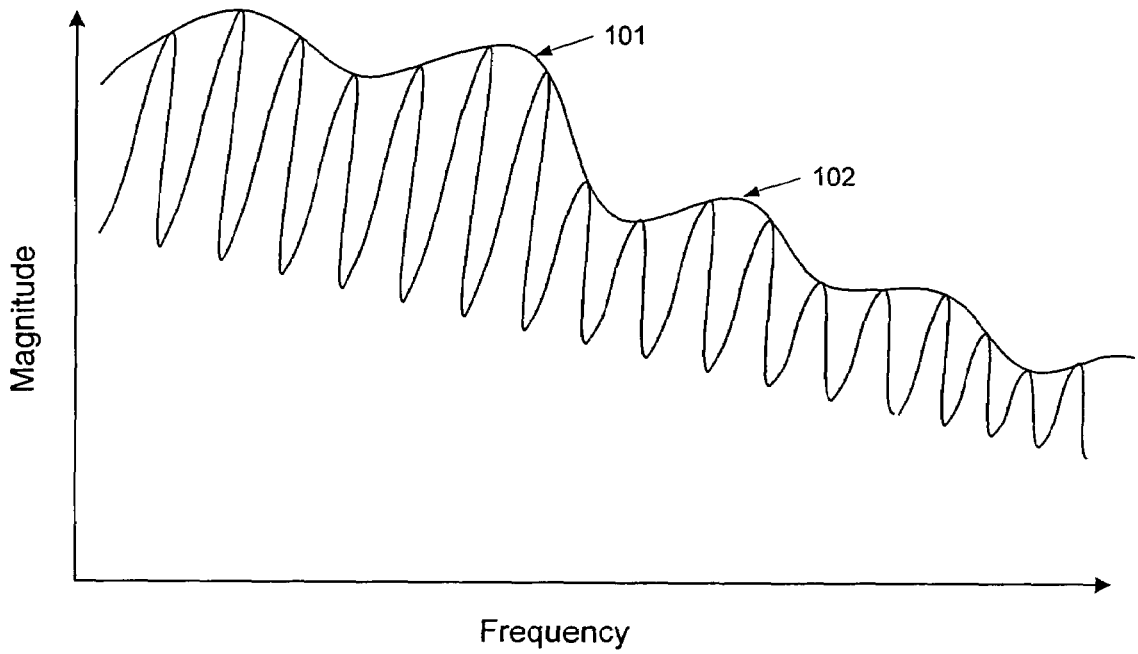
FIG. 1 represents the spectrum of an input speech signal.

FIG. 1 is an illustration of the frequency domain of a sample speech signal. The spectrum of speech signal represented in this illustration may be in the wideband, which extends from slightly above 0.0 Hz to around 8.0 kHz for a speech signal sampled at 16 kHz. The spectrum may also be in the narrowband. Thus, it should be understood by those of skill in the art that the speech signal in this illustration may be applicable to any desired speech band.

Figure 2:
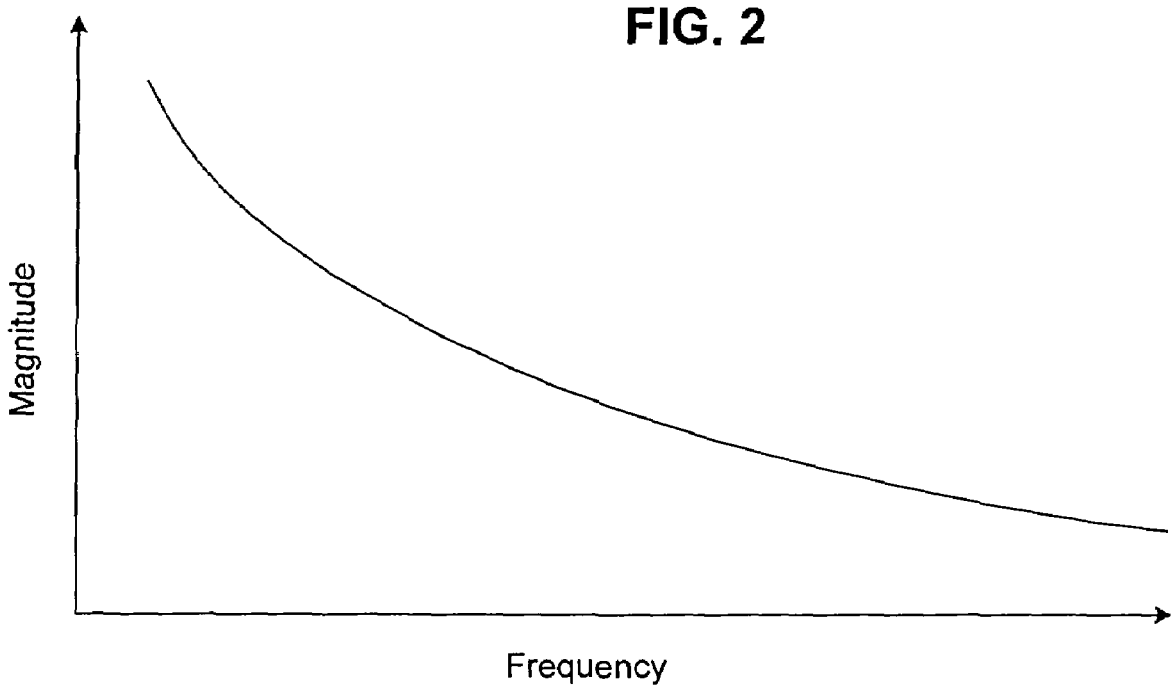
FIG. 2 represents a typical background noise spectrum.

FIG. 2 represents a typical background noise spectrum in the input speech of FIG. 1. As illustrated, in most cases the background noise has no obvious formant (i.e. frequency peaks), for example, peaks 101 and 102 of FIG. 1, and gradually decays from low frequency to high frequency. Embodiments of the present invention provide simple algorithms for suppression (i.e. removal) of background noise from the input speech without the computational expense of performing Fast Fourier Transformations.

In an embodiment of the present invention, background noise is suppressed by reducing the energy of the relatively noisy frequency components. To accomplish this, the spectrum of the noisy input signal is represented using an LPC (Linear Predictive Coding) model in the z-domain as Fs(z). The LPC model is obtained by simply performing LPC analysis.

Because of the shape of the noise spectrum, e.g. FIG. 2, it is usually adequate to represent the noise spectrum, Fn(z), with a simple first order LPC filter. Thus, in one embodiment, when the spectrum tilt of the noisy speech is close to the spectrum tilt of the background noise model, only the spectrum valley areas of the Fs(z) (i.e. noisy components of the speech signal in the frequency-domain) needs to be reduced. However, when the spectrum tilt of the noisy speech is not close to (e.g. less than) the spectrum tilt of the background noise model, then an inverse filter of the Fn(z) model, e.g., 1/Fn(z), may be used to decrease the energy of the noise component. Because Fs(z) and Fn(z) are usually poles filters, 1/Fs(z) and 1/Fn(z) become zeros filters.

Thus, when the input signal contains speech, one embodiment of the invention filters the noisy speech using the following combined filter:

$$[1/Fn(z/a)].Fs(z/b)/Fs(z/c) \qquad g.$$

where the parameters a ($0<=a<1$), b ($0<b<1$), and c ($0<c<1$) are adaptive coefficients for bandwidth expansion; and g is an adaptive gain to maintain signal energy. The parameters a, b, c, and g are controlled by the noise-to-signal ratio (NSR). NSR is used instead of the traditional SNR (Signal-to-noise ratio) because it provides known bounds (0-1) that can easily be applied.

And when the signal is determined to be pure background, i.e., no speech content, an embodiment of the present invention only reduces the signal energy.

Figure 3:
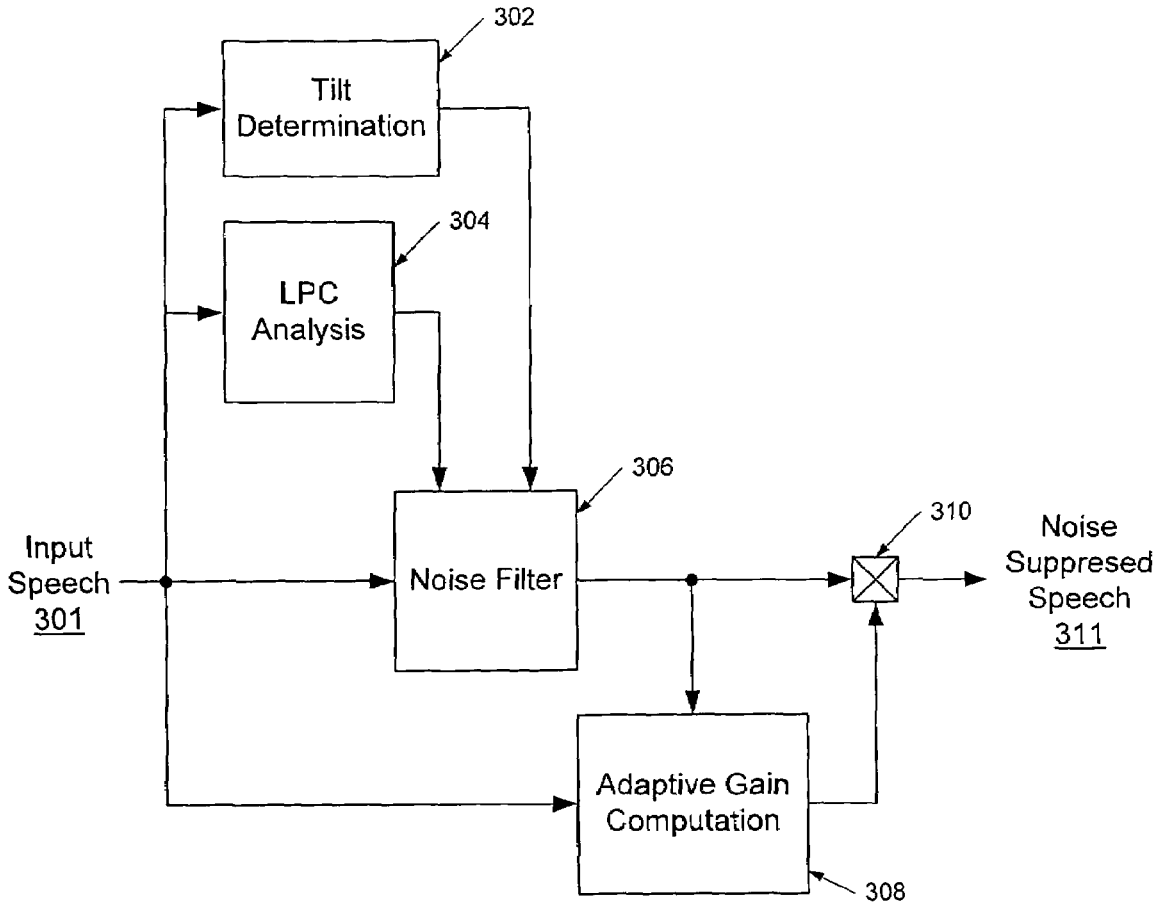
FIG. 3 is a block diagram illustrating the main features of the noise suppression algorithm.

An implementation of the noise suppression in accordance with an embodiment of the present invention is presented in the code listed in the appendix. FIG. 3 is a block diagram illustrating the main features of the noise suppression algorithm.

As illustrated, an input speech 301 is processed through LPC analysis 304 to obtain the LPC model (e.g. parameters). Normally, the noisy signal has been divided into frames and processed to determine its speech content and other characteristics. Thus, Input speech 301 will usually be a frame of several samples. The frame is processed in block 302 to determine filter tilt. Input speech 301 is then filtered by the noise suppression filters using the LPC parameters and tilt. An adaptive gain is computed based on the input speech 301 and the filtered output, which is used to control the energy of the noise suppressed speech 311 output.

Figure 4:
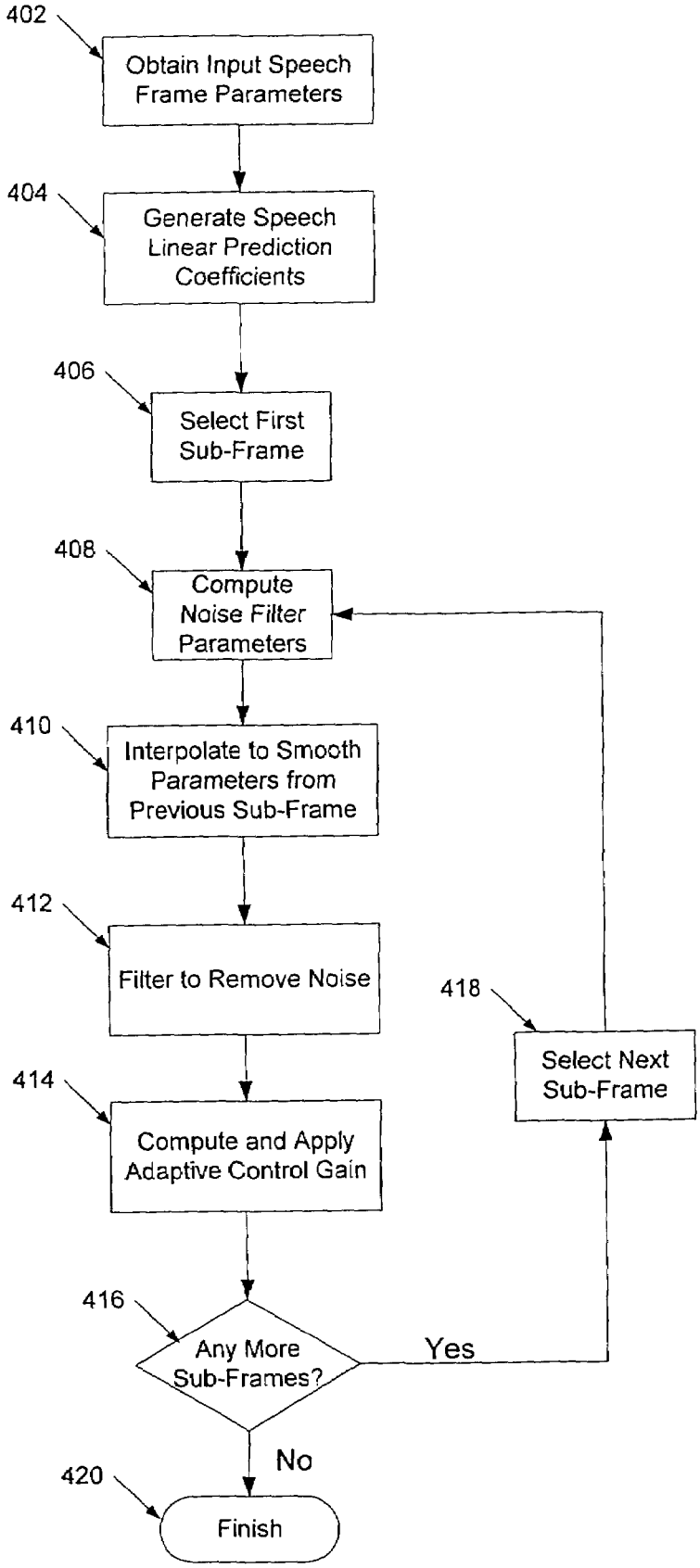
FIG. 4 is a high-level process flowchart of the noise suppression algorithm.

The above process is further illustrated in FIG. 4, which is a high-level process flowchart of the noise suppression algorithm presented in the appendix. As illustrated, a frame of the noisy speech is obtained in block 402. In block 404, an LPC analysis is performed to generate the linear prediction coefficients for the frame.

Each frame is divided into sub-frames, which are analyzed in sequence. For instance, in block 406 the first sub-frame is selected for analysis. In block 408, the noise filter parameters, e.g., spectrum tilt and bandwidth expansion factor, are computed for the selected sub-frame and, in block 410, interpolation is performed to, smooth parameters from the previous sub-frame. The spectrum tilt and bandwidth expansion factor modify the LP coefficients based on the noise-to-signal ratio of the signal in the sub-frame.

Figure 5:
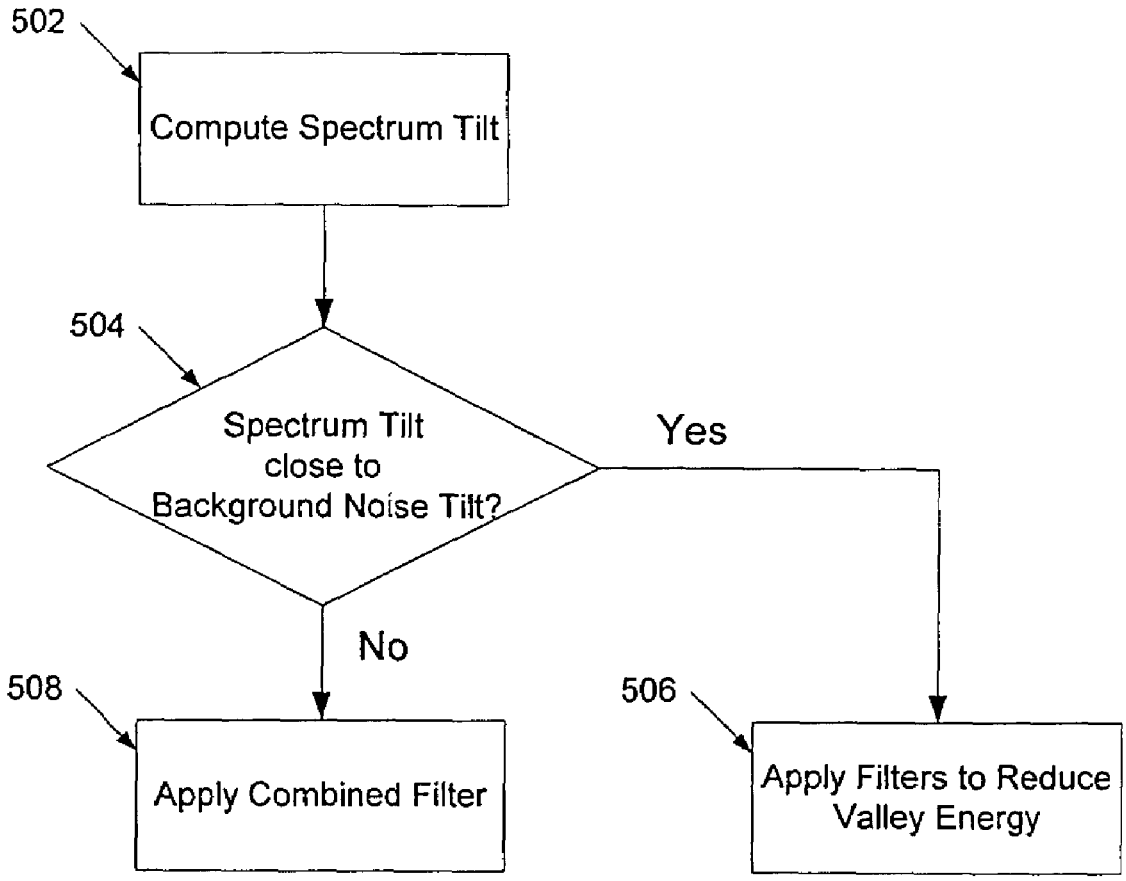
FIG. 5 is an illustration of controlling noise suppression processing using spectrum tilt of each sub-frame.

The spectrum tilt controls the type of processing performed on that sub-frame as illustrated in FIG. 5. As illustrated, the spectrum tilt for each sub-frame is computed in block 502. A determination is made in block 504 whether the spectrum tilt is equivalent to that of a pure background noise. If it is, then only the energy components of the input speech in the spectral valley areas is reduced in block 506, for example, by making b>>c in block 306 (see FIG. 3).

If on the other hand, the spectrum tilt of the sub-frame is not that of background noise, the inverse filter is applied using the combined filter function previously described on block 508.

Referring back to FIG. 4, the sub-frame is filtered through three filters 1/Fn(z/a), Fs(z/b), and Fs(z/c) in block 412 (the combined filter). The filter 1/Fn(z/a) could be simply a first order inverse filter representing the noise spectrum. The other two filters are an all-zero and an all-pole filter of a desired order.

Finally, the adaptive gain (e.g. g) is computed in block 414 and applied to the filtered sub-frame to generate the noise filtered sub-frame. The gain can make the output energy significantly lower than the input energy when NSR is close to 1; if NSR is near zero, the gain maintains the output energy to be almost the same as the input. The remaining sub-frames are processed after a determination in block 416 whether there are additional sub-frames to process. If there are, processing proceeds to block 418 to select a new frame and then returns back to block 408 to begin the filtering process for the selected sub-frame. This process continues until all sub-frames are processed and then processing exits at block 420 to await a new input frame.

Although the above embodiments of the present application are described with reference to wideband speech signals, the present invention is equally applicable to narrowband speech signals.

The methods and systems presented above may reside in software, hardware, or firmware on the device, which can be implemented on a microprocessor, digital signal processor, application specific IC, or field programmable gate array ("FPGA"), or any combination thereof, without departing from the spirit of the invention. Furthermore, the present invention may be embodied in other specific forms without departing from its spirit or essential characteristics. The described embodiments are to be considered in all respects only as illustrative and not restrictive.

APPENDIX

```
/*==========================================          */
/*------------------
```

APPENDIX-continued

```
                FLOAT64 *T1, FLOAT64 bwe_v0[])
  {
  FLOAT64 C, gamma0;
  FLOAT64 nsr, nsr_g, nsr_dB;
  /*-----------------------------------------------------------------*/
  /*                          NSR                                    */
  /*-----------------------------------------------------------------*/
  if (sns->Vad==0) {
     nsr =1.0;
     nsr_g=1.0;
     nsr_dB = 1.0;
     sns->r1_sm = sns->r1_nois;
     }
  else {
     nsr = sns->r0_nois/sqrt(MAX(eng0, 1.0));
     nsr_g = (nsr-0.02)*1.35;
     nsr_g = MIN(MAX(nsr_g, 0.0), 1.0);
     nsr_g = SQR(nsr_g);
     nsr_dB=20.0*log10(MAX(nsr, EPSI)) + 8;
     nsr_dB=(nsr_dB+26.0)/26.0;
     nsr_dB=MIN(MAX(nsr_dB, 0.0), 1.0);
     }
  if ( sns->r0_nois < sns->floor_min ) {
     nsr_g = 0;
     nsr =0.0;
     nsr_dB = 0.0;
     }
  /*-----------------------------------------------------------------*/
  /*                      Gain control                               /*
  /*-----------------------------------------------------------------*/
  *G = 1.0 - CTRL*nsr_g;
  gain_sm = 0.5*gain_sm + 0.5*(*G);
  *G = gain_sm;
  /*-----------------------------------------------------------------*/
  /*                      Tilt filter control                        */
  /*-----------------------------------------------------------------*/
  C = TILT_C*nsr*SQR(sns->r1_nois);
  if (sns->r1_nois>0) C = -C;
  C += sns->r1_sm - sns->r1_nois;
  C *= nsr_dB*CTRL;
  C = MIN(MAX(C, -0.75), 0.25);
  t1_sm = 0.5*t1_sm + 0.5*C;
  *T1 = t1_sm;
  /*-----------------------------------------------------------------*/
  /*                      Zeros filter control                       */
  /*-----------------------------------------------------------------*/
  gamma0 = nsr_dB*GAMMA0 + (1-nsr_dB)*GAMMA1;
  gamma0_sm = 0.5*gamma0_sm + 0.5*gamma0;
  BandExpanVec(bwe_v0, NP, gamma0_sm);
  /*-----------------------------------------------------------------*/
  return;
  /*-----------------------------------------------------------------*/
  }
/*=================================================================*/
/* FUNTION :   Simple_NS ( ).                                      */
/*-----------------------------------------------------------------*/
/* PURPOSE :   Very Simple Noise Suppressor                        */
/*-----------------------------------------------------------------*/
/* INPUT ARGUMENTS :                                               */
/*                                                                 */
/* _ (FLOAT64 []) sig   : input and output speech segment          */
/* _ (INT16) l_frm : input speech segment size                     */
/* _ (SNS_PARAM) sns : structure for global variables              */
/*-----------------------------------------------------------------*/
/* OUTPUT ARGUMENTS :                                              */
/* _ (FLOAT64 []) sig : input and output speech segment            */
/*-----------------------------------------------------------------*/
/* RETURN ARGUMENTS : _ None.                                      */
/*=================================================================*/
void Simple_NS(FLOAT64 *sig, INT16 l_frm, SNS_PARAM *sns)
  {
  FLOAT64 *sig_buff;
  FLOAT64 R[NP+1], pderr;
  FLOAT64 refl[NP], pdcf[NP];
  FLOAT64 tmpmem[NP+1], pdcf_k[NP];
  FLOAT64 gain, tilt1, bwe_vec0[NP];
  FLOAT64 C, g, eng0, eng1;
  INT16 i, k, i_s, l_sf;
  /*-----------------------------------------------------------------*/
```

APPENDIX-continued

```
  /*                    Initialization                               */
  /*-----------------------------------------------------------------*/
  if (sns->count_frm<=1)
     Init_ns(l_frm);
  sig_buff = dvector(0, LPC-1);
  /*-----------------------------------------------------------------*/
  /*                      LPC analysis                               */
  /*-----------------------------------------------------------------*/
  cpy_dvector(sig_mem, sig_buff, 0, L_MEM-1);
  cpy_dvector(sig, sig_buff+L_MEM, 0, FRM-1);
  cpy_dvector(sig_buff+FRM, sig_mem, 0, L_MEM-1);
  cpy_dvector(sig_buff+LPC-LKAD-FRM, sig, 0, FRM-1);
  mul_dvector (sig_buff, window, sig_buff, 0, LPC-1);
  LPC_autocorrelation (sig_buff, LPC, R, (INT16)(NP+1));
  mul_dvector (R, bwe_fac, R, 0, NP);
  R[0] = MAX(R[0], 1.0);
  LPC_levinson_durbin (NP, R, pdcf, refl, &pderr);
  if (sns->Vad==0) {
     for (i=0; i<NP; i++)
        refl[i] = 0.75*refl_old[i] + 0.25*refl[i];
        }
/*-----------------------------------------------------------------*/
  /*            Interpolation and Filtering                         */
  /*-----------------------------------------------------------------*/
  i_s=0;
  for (k=0;k<SF_N;k++) {
     l_sf = SUBF[k];
  /*---------------- Interpolation --------------------------*/
  C = (k+1.0)/(FLOAT64)SF_N;
  if (k<SF_N-1 || sns->Vad==0) {
     for (i=0; i<NP; i++)
        tmpmem[i] = C*refl[i] + (1-C)*refl_old[i];
     LPC_ktop(tmpmem, pdcf_k, NP);
     }
  else {
     cpy_dvector(pdcf, pdcf_k, 0, NP-1);
     }
  /*-----------------------------------------------------------*/
  dot_dvector(sig+i_s, sig+i_s, &eng0, 0, l_sf-1);
  param_ctrl (sns, (eng0/l_sf), &gain, &tilt1, bwe_vec0);
  /*---------------- Filtering ------------------------------*/
  dot_dvector(sig+i_s, sig+i_s, &eng0, 0, l_sf-1);
  tmpmem[0]=1.0;
  mul_dvector (pdcf_k, bwe_vec0, tmpmem+1, 0, NP-1);
  FLT_filterAZ (tmpmem, sig+i_s, sig+i_s, zero_mem, NP, l_sf);
  tmpmem[1]=tilt1;
  LT_filterAZ (tmpmem, sig+i_s, sig+i_s, &z1_mem, 1, l_sf);
  mul_dvector (pdcf_k, bwe_vec1, tmpmem, 0, NP-1);
  FLT_filterAP (tmpmem, sig+i_s, sig+i_s, pole_mem, NP, l_sf);
  /*---------------- gain control ---------------------------*/
  dot_dvector(sig+i_s, sig+i_s, &eng1, 0, l_sf-1);
  g = gain * sqrt(eng0/MAX(eng1, 1.));
  for (i = 0; i < l_sf; i++)
     {
     agc = 0.9*agc + 0.1*g;
     sig[i+i_s] *= agc;
     }
  /*-----------------------------------------------------------*/
  i_s += l_sf;
  }
  /*-----------------------------------------------------------------*/
  /*                  memory update                                  */
  /*-----------------------------------------------------------------*/
  cpy_dvector(refl, refl_old, 0, NP-1);
  /*-----------------------------------------------------------*/
  free_dvector(sig_buff, 0, LPC-1);
  /*-----------------------------------------------------------*/
  return;
  /*-----------------------------------------------------------*/
  }
```

What is claimed is:

1. A method for suppressing background noise from a speech signal, said method comprising:

obtaining an input speech signal;

performing linear predictive coding (LPC) analysis on said input speech signal to obtain a z-domain representation of said input speech signal;

computing a spectrum tilt and a noise-to-signal ratio (NSR) of said z-domain representation of said input speech signal;

obtaining a spectrum tilt of a background noise model;

applying a gain to reduce energy of said input speech signal when said NSR is high;

reducing a spectral valley energy of said input speech signal when said spectrum tilt of said input speech signal is equivalent to said spectrum tilt of said background noise model; and applying an inverse filter to said input speech signal when said spectrum tilt of said input speech signal is not equivalent to said spectrum tilt of said background noise model, wherein said inverse filter is an inverse of a z-domain representation of said background noise model.

2. The method of claim 1, wherein said input speech signal comprises a plurality of sub-frames processed in sequence.

3. The method of claim 1, wherein said gain is adaptively based on characteristics of said input speech.

4. The method of claim 1, wherein said background noise model is a first order model.

5. The method of claim 1, wherein applying said gain, reducing said spectral valley energy and applying said inverse filter are performed using g.[1/Fn(z/a)].Fs(z/b)/Fs(z/c), wherein parameters a (0<=a<1), b (0<b<1), and c (0<c<1) are adaptive coefficients, and parameter g is an adaptive gain.

6. The method of claim 5, wherein said parameters a, b, c, and g are controlled by said NSR.

7. A computer program product comprising:

a computer usable medium having computer readable program code embodied therein for suppressing background noise from a speech signal; said computer readable program code configured to cause a computer to:

obtain an input speech signal;

perform linear predictive coding (LPC) analysis on said input speech signal to obtain a z-domain representation of said input speech signal;

compute a spectrum tilt and a noise-to-signal ratio (NSR) of said z-domain representation of said input signal;

obtain a spectrum tilt of a background noise model;

apply a gain to reduce energy of said input speech signal when said NSR is high;

reduce a spectral valley energy of said input speech signal when said spectrum tilt of said input speech signal is equivalent to said spectrum tilt of said background noise model; and apply an inverse filter to said input speech signal when said spectrum tilt of said input speech signal is not equivalent to said spectrum tilt of said background noise model, wherein said inverse filter is an inverse of a z-domain representation of said background noise model.

8. The computer program product of claim 7, wherein said input speech signal comprises a plurality of sub-frames processed in sequence.

9. The computer program product of claim 7, wherein said gain is adaptively based on characteristics of said input speech.

10. The computer program product of claim 7, wherein said background noise model is a first order model.

11. The computer program product of claim 7, wherein said computer readable program code to apply said gain, reduce said spectral valley energy and apply said inverse filter are performed using g.[1/Fn(z/a)].Fs(z/b)/Fs(z/c), wherein parameters a (0<=a<1), b (0<b<1), and c (0<c<1) are adaptive coefficients, and parameter g is an adaptive gain.

12. The computer program product of claim 11, wherein said parameters a, b, c, and g are controlled by said NSR.

13. An apparatus for suppressing background noise from a speech signal, said apparatus comprising:

an object for receiving an input speech signal;

an object for performing linear predictive coding (LPC) analysis on said input speech signal to obtain a z-domain representation of said input speech signal;

an object for computing a spectrum tilt and a noise-to-signal ratio (NSR) of said z-domain representation of said input signal;

an object for obtaining a spectrum tilt of a background noise model;

an object for applying a gain to reduce energy of said input speech signal when said NSR is high;

an object for reducing a spectral valley energy of said input speech signal when said spectrum tilt of said input speech signal is equivalent to said spectrum tilt of said background noise model; and an object for applying an inverse filter to said input speech signal when said spectrum tilt of said input speech signal is not equivalent to said spectrum tilt of said background noise model, wherein said inverse filter is an inverse of a z-domain representation of said background noise model.

14. The apparatus of claim 13, wherein said input speech signal comprises a plurality of sub-frames processed in sequence.

15. The apparatus of claim 13, wherein said gain is adaptive based on characteristics of said input speech.

16. The apparatus of claim 13, wherein said background noise model is a first order model.

17. The apparatus of claim 13, wherein said objects for applying said gain, reducing said spectral valley energy and applying said inverse filter are performed using g.[1/Fn(z/a)].Fs(z/b)/Fs(z/c), wherein parameters a (0<=a<1), (0<b<1), and c (0<c<1) are adaptive coefficients, and parameter g is an adaptive gain.

18. The apparatus of claim 17, wherein said parameters a, b, c, and g are controlled by said NSR.

* * * * *

UNITED STATES PATENT AND TRADEMARK OFFICE

CERTIFICATE OF CORRECTION

PATENT NO. : 7,379,866 B2
APPLICATION NO. : 10/799505
DATED : May 27, 2008
INVENTOR(S) : Yang Gao It is certified that error appears in the above-identified patent and that said Letters Patent is hereby corrected as shown below:

In the claims, column 10, line 5, "adaptively" should be changed to --adaptive--.

In the claims, column 10, line 54, "(0<b<1), and c (0<c<1)" should be changed to --b (0<b<1), and c (0<c<1)--.

Signed and Sealed this

Second Day of September, 2008

JON W. DUDAS
*Director of the United States Patent and Trademark Office*